US010326202B2

(12) United States Patent
Vigano et al.

(10) Patent No.: US 10,326,202 B2
(45) **Date of Patent: *Jun. 18, 2019**

(54) APERIODIC PHASED ARRAY ANTENNA WITH SINGLE BIT PHASE SHIFTERS

(71) Applicant: VIASAT, INC., Carlsbad, CA (US)

(72) Inventors: Maria C Vigano, Lausanne (CH); Daniel Llorens Del Rio, Lausanne (CH); Stefano Vaccaro, Gland (CH)

(73) Assignee: VIASAT, INC., Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/137,327

(22) Filed: Sep. 20, 2018

(65) Prior Publication Data

US 2019/0051985 A1 Feb. 14, 2019

Related U.S. Application Data

(63) Continuation of application No. 14/380,223, filed as application No. PCT/US2013/029751 on Mar. 8, 2013, now Pat. No. 10,109,916.

(Continued)

(51) Int. Cl.

*H01Q 3/36* (2006.01)
*H01Q 3/38* (2006.01)

(Continued)

(52) U.S. Cl.

CPC ..... *H01Q 3/36* (2013.01); *H01Q 3/38* (2013.01); *H01Q 21/0006* (2013.01); *H01Q 21/065* (2013.01); *H01Q 21/20* (2013.01); *H01Q 21/245* (2013.01); *H01Q 9/0435* (2013.01); *H01Q 9/0457* (2013.01)

(58) Field of Classification Search

CPC ..... H01Q 3/26; H01Q 3/2682; H01Q 3/2694; H01Q 3/30; H01Q 3/34; H01Q 3/36; H01Q 21/065; H01Q 21/24; H01Q 21/245; H01Q 25/001

See application file for complete search history.

(56) References Cited

U.S. PATENT DOCUMENTS 10,109,916 B2 10/2018 Vigano et al.
2002/0167449 A1 11/2002 Frazita et al.

(Continued)

FOREIGN PATENT DOCUMENTS

EP 2823532 B1 3/2018
WO WO 2013/134585 9/2013

OTHER PUBLICATIONS

International Search Report and Written Opinion mailed in International (PCT) Application No. PCT/US2013/029751 dated May 8, 2013, 12 pgs.

(Continued)

*Primary Examiner* — Robert Karacsony

(57) ABSTRACT

An antenna array can include multiple radiating cells, each comprising a radiating element and a phase shifter. Further, each radiating element can comprise a first radiating element port and a second radiating element port. Each of the radiating cells can be configured to selectively connect the phase shifter to one of the radiating element ports. Each of the radiating cells can further comprise a phase delay difference between the signal paths associated with the radiating element ports. Further, the radiating cells can have physical polarization orientations that can be different from at least one other radiating cell.

10 Claims, 11 Drawing Sheets

Related U.S. Application Data

(60) Provisional application No. 61/608,987, filed on Mar. 9, 2012.

(51) Int. Cl.

| | |
|---|---|
| ***H01Q 9/04*** | (2006.01) |
| ***H01Q 21/00*** | (2006.01) |
| ***H01Q 21/06*** | (2006.01) |
| ***H01Q 21/20*** | (2006.01) |
| ***H01Q 21/24*** | (2006.01) |

(56) References Cited

U.S. PATENT DOCUMENTS

| | | | |
|---|---|---|---|
| 2008/0129595 | A1 | 6/2008 | Choi et al. |
| 2008/0218424 | A1 | 9/2008 | Blanton |
| 2010/0073233 | A1 | 3/2010 | Young et al. |
| 2010/0109960 | A1 | 5/2010 | Guler et al. |
| 2010/0253585 | A1 | 10/2010 | Llorens Del Rio et al. |
| 2011/0032079 | A1 | 2/2011 | Bloy et al. |
| 2011/0074630 | A1 | 3/2011 | Snow |
| 2011/0074646 | A1 | 3/2011 | Snow |
| 2011/0090129 | A1 | 4/2011 | Weily et al. |
| 2015/0022421 | A1 | 1/2015 | Vigano et al. |

OTHER PUBLICATIONS

International Preliminary Report on Patentability mailed in International (PCT) Application No. PCT/US2013/029751 dated May 12, 2015, 8 pgs.

Extended European Search Report mailed in European Patent Application No. 13757406.7 dated Jun. 24, 2016, 11 pgs.

Communication under Rule 71(3) EPC: Intention to Grant mailed in European Patent Application No. 13757406.7 dated Sep. 8, 2017, 7 pgs.

Decision to Grant mailed in European Patent Application No. 13757406.7 dated Feb. 8, 2018, 2 pgs.

Changrong et al., "Circularly Polarized Beam-Steering Antenna Array With Butler Matrix Network", IEEE Antennas and Wireless Propagation Letters, vol. 10, Nov. 21, 2011, pp. 1278-1281.

Werner et al, "Fractal Antennas", Antenna Engineering Handbook, Fourth Edition, Chapter 33, Dec. 31, 2007, The McGraw-Hill Companies, ISBN-13: 978-0071475747, 29 pgs.

APERIODIC PHASED ARRAY ANTENNA WITH SINGLE BIT PHASE SHIFTERS

CROSS-REFERENCE TO RELATED APPLICATIONS

This application is a continuation of U.S. patent application Ser. No. 14/380,223, entitled "APERIODIC PHASED ARRAY ANTENNA WITH SINGLE BIT PHASE SHIFTERS," filed Aug. 21, 2014; which application is a National Stage Entry of PCT/US13/29751, entitled "Aperiodic Phased Array Antenna with Single Bit Phase Shifters," filed Mar. 8, 2013; which application claims priority to U.S. Provisional Application No. 61/608,987, entitled "Aperiodic Phased Array Antenna with Single Bit Phase Shifters," which was filed on Mar. 9, 2012, the contents of each of which are hereby incorporated by reference for any purpose in their entirety.

FIELD

This application is relevant to the field of radio frequency (RF) antennas, and more particularly, to RF mobile terminal antenna arrays having radiating cells that each comprises a radiating element, a switch and a phase shifter.

BACKGROUND

Some of the challenges for mobile terminal antennas for satellite-based communications can include generating a polarization that depends on the relative position of a satellite and a terminal (for linearly polarized systems). It can also be a challenge to, at the same time, scan the beam for an arbitrary azimuth. Typically, these challenges have been addressed by use of a direct radiating antenna array (DRA), where each element has independent phase controls. Typical phased arrays comprise a large number of components for each radiating element and can be expensive. Moreover, typical phased arrays use phase shifters with a large number of bits, often 4, 5, or 6 or more bits. Thus, such solutions tend to involve expensive and large microwave electronic circuits. Moreover, typically, the use of simpler phase controls with fewer bits can have more coarse control and correspondingly dramatic undesirable effects on the performance of the DRA.

SUMMARY

In an example embodiment, an antenna array can include a first radiating cell and a second radiating cell. Each of the first and second radiating cells can comprise a radiating element and a phase shifter. Further, each radiating element can comprise a first radiating element port and a second radiating element port. Each of the first and second radiating cells can be configured to selectively connect the phase shifter to one of the first radiating element port and the second radiating element port. Each first and second radiating cell can further comprise a phase delay difference between the signal paths associated with the first and second radiating element ports. And the first radiating cell can be rotated relative to the second radiating cell.

In an example embodiment, a method of controlling an antenna array can comprise receiving a first one-bit control signal to control a first phase shifter in a first radiating cell, wherein the first radiating cell can comprise a first switch, the first phase shifter, and a first radiating element comprising a first radiating element port and a second radiating element port. The method can further comprise using the first switch to selectively connect the first phase shifter to one of the first radiating element port and the second radiating element port of the first radiating element. The method can further comprise receiving a second one-bit control signal to control a second phase shifter in a second radiating cell, wherein the second radiating cell can comprise a second switch, the second phase shifter, and a second radiating element comprising a third radiating element port and a fourth radiating element port. The method can further comprise using the second switch to selectively connect the second phase shifter to one of the third radiating element port and the fourth radiating element port of the second radiating element. The first radiating cell can be rotated relative to the second radiating cell. The method can further comprise providing a first phase delay difference between the signal paths associated with the first and second radiating element ports, and providing a second phase delay difference between the signal paths associated with the third and fourth radiating element ports.

In an example embodiment, an antenna array can include: a first radiating cell comprising a radiating cell input/output port, a phase shifter (PS) having a first PS port and a second PS port, a radiating element (RE) having a first RE trace and a second RE trace, and a switch configured to selectively connect the second PS port to the first and second RE traces. The first PS port can be connected to the radiating cell input/output port. The radiating cell can further comprise a phase delay difference between the first and second RE traces. The antenna array can further comprise a second radiating cell, wherein the first radiating cell can be rotated relative to the second radiating cell.

In an example embodiment, an antenna array can include: a plurality of radiating elements, where each of the plurality of radiating elements can be a dual linear polarized radiating element. The plurality of radiating elements can comprise a first radiating element having a first physical polarization orientation and a second radiating element having a second physical polarization orientation. The first physical polarization orientation can be different than the second physical polarization orientation. Each of the plurality of radiating elements can comprise a first leg having a first phase delay and a second leg having a second phase delay. The first delay can be different from the second delay. Each radiating element of the plurality of radiating elements can be associated with a switch and a phase shifter and the switch can be configured to connect the phase shifter to one of the first and second legs.

In an example embodiment, an antenna array can include a first radiating cell and second radiating cell. Each of the first and second radiating cells can comprise a switch connected between a radiating element and a phase shifter. The switch can be configured to selectively connect the phase shifter to one of a first radiating element port and a second radiating element port. Each of the first and second radiating cells can further comprise a phase delay difference between the signal paths associated with the first and second radiating element ports. Moreover, the first radiating cell can be rotated relative to the second radiating cell.

BRIEF DESCRIPTION OF THE DRAWING FIGURES

Additional aspects of the present invention will become evident upon reviewing the non-limiting embodiments described in the specification and the claims taken in conjunction with the accompanying figures, wherein like numerals designate like elements, and:

DETAILED DESCRIPTION

Figure 1:
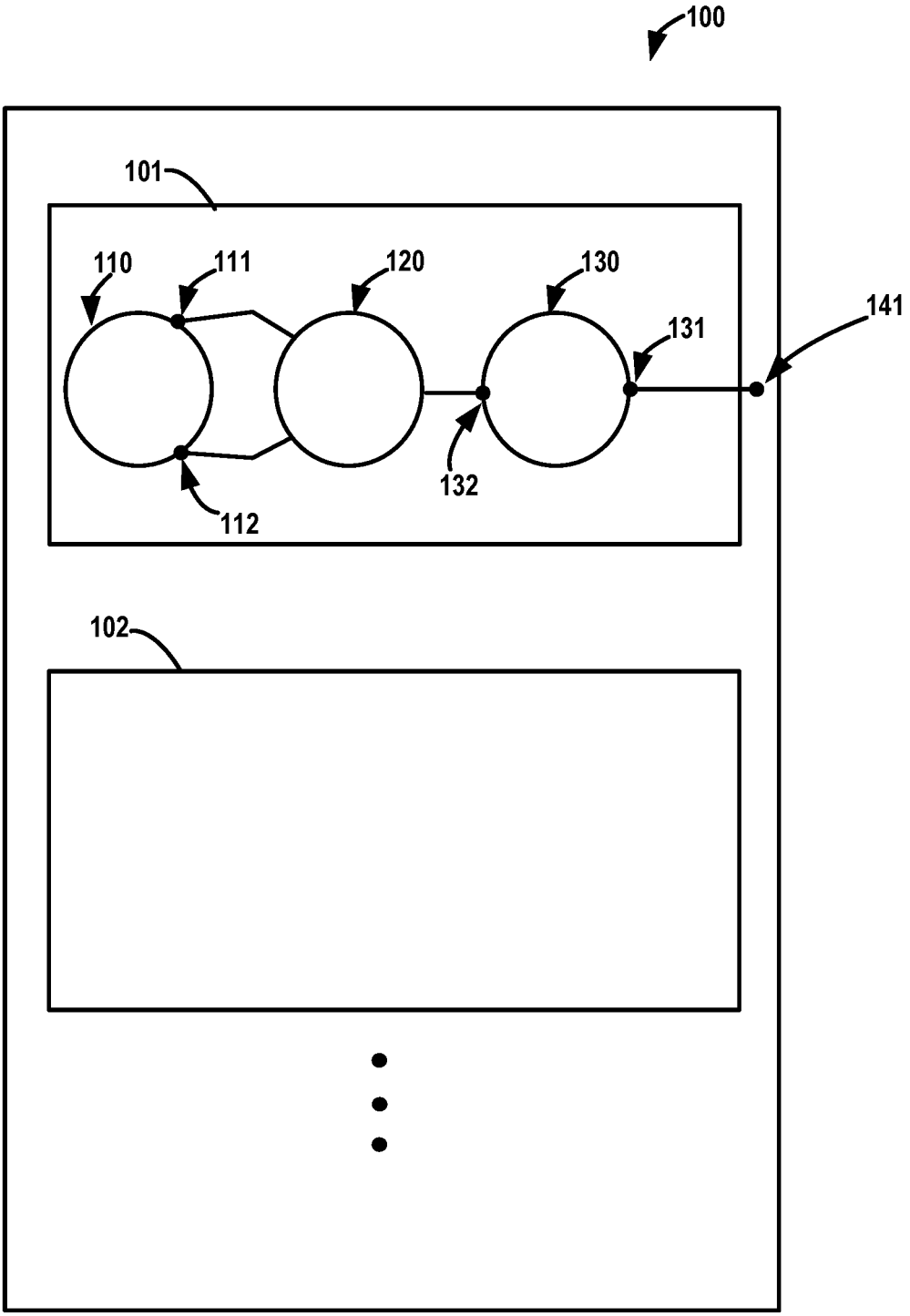
FIG. 1 is a block diagram of an example antenna array comprising radiating cells.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

In accordance with an example embodiment, an array design can retain acceptable performance even though used with coarse phase controls. The phase controls can be as simple as a single bit phase control. For example, a radiating cell in an antenna array can be configured to provide phase control with a single bit phase controller. The radiating cell can be used in a specific array lattice with a particular element rotation. In an example embodiment, the antenna array can be configured to reduce the size and/or cost of the antenna array.

In a satellite-earth communication system where the earth terminal is mobile, the position of the satellite relative to the antenna frame of reference can vary with time. If an omnidirectional antenna is used in the earth terminal, the antenna gain can be approximately constant with time. However, such antennas can have a very limited gain, and therefore can be inappropriate for many satellite applications. If a high-gain antenna is used at the earth terminal, either the platform or the antenna itself can be configured to track the position of the satellite.

In addition, if the communication system is linearly polarized, either the platform or the antenna can be configured to rotate the polarization of the antenna beam. This can involve an additional degree of freedom. If the platform tracks the satellite mechanically, the resulting system can be cumbersome and susceptible to mechanical failure. In other terminals, the antenna itself can be configured to track the satellite, by means of electronic scanning. Wide-scan electronic scanning can be used to track geostationary satellites at moderately high latitudes. However, such scanning typically involves a high density of electronic components, typically one per radiating cell in the array. Typically, such scanning involves phase shifters with 3, 4, 5, or more control bits. Thus, typical wide-scan electronic scanning solutions in phased array antennas have been expensive and large.

In accordance with an example embodiment, an antenna array can comprise at least two radiating cells, e.g., a first and second radiating cell. In accordance with an example embodiment, an antenna array comprises a plurality of radiating cells. For example, an antenna array can comprise three or more radiating cells. In an example embodiment, an antenna array can comprise more than 100, or more than 1000 radiating cells. Moreover, the number of radiating cells can be any suitable number of radiating cells.

In various embodiments, each radiating cell can comprise a switch connected between a radiating element and a phase shifter. The switch can be configured to selectively connect the phase shifter to one of first and second radiating element ports. The radiating cell can further comprise a phase delay difference between the first and second radiating element ports. Moreover, the first radiating cell can be rotated relative to the second radiating cell.

In an example embodiment, and with reference to FIG. 1, antenna array 100 can comprise a first radiating cell 101 and a second radiating cell 102. As the second radiating cell can be similar to the first radiating cell, only the first radiating cell will be described in detail.

Figure 2:
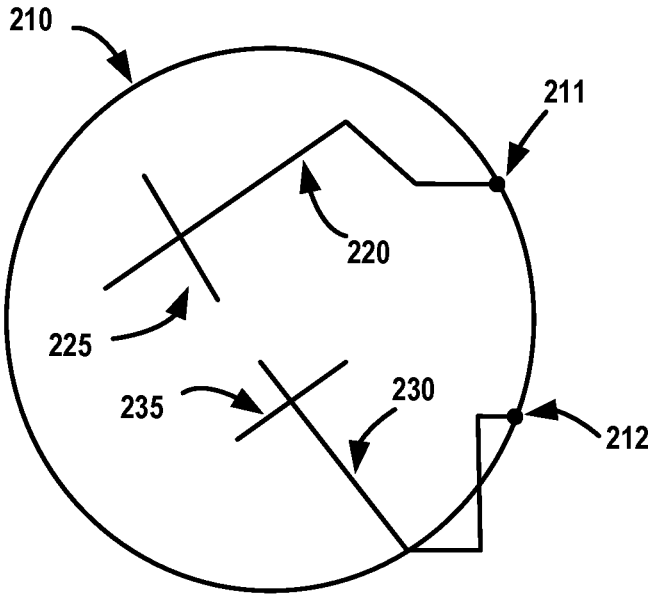
FIG. 2 is a more detailed block diagram of an example antenna array comprising radiating cells.

First radiating cell 101 can comprise a radiating cell input/output port 141. First radiating cell 101 can also comprise a phase shifter ("PS") 130 having a first PS port 131 and a second PS port 132. In an example embodiment, first PS port 131 can be connected to radiating cell input/output port 141. First radiating cell 101 can also comprise a radiating element ("RE") 110. RE 110 can comprise a first RE port 111 and a second RE port 112. First radiating cell 101 can also comprise a switch 120. Switch 120 can be configured to selectively connect the second PS port 132 to the first and/or second RE ports 111/112. In an example embodiment, radiating cell 101 can further comprise a phase delay difference between the first and second RE ports. Stated another way, and with momentary reference to FIG. 2, First radiating cell 101 can comprise a first RE trace 220 and a second RE trace 230. Switch 120 can be configured to selectively connect the second PS port 132 to the first and/or second RE traces 220/230. In an example embodiment, radiating cell 101 can further comprise a phase delay difference between the first and second RE traces.

In an example embodiment, second radiating cell 102 can be rotated relative to first radiating cell 101. Stated another way, the first radiating cell can have a first physical polarization orientation, the second radiating cell can have a second physical polarization orientation, and the first physical polarization orientation can be rotated relative to the second physical polarization orientation. Moreover, in another example embodiment, the first radiating cell can have a first radiating element having a first physical polarization orientation, the second radiating cell can have a second radiating element having a second physical polarization orientation, and the first physical polarization orientation can be rotated relative to the second physical polarization orientation.

Figure 8:
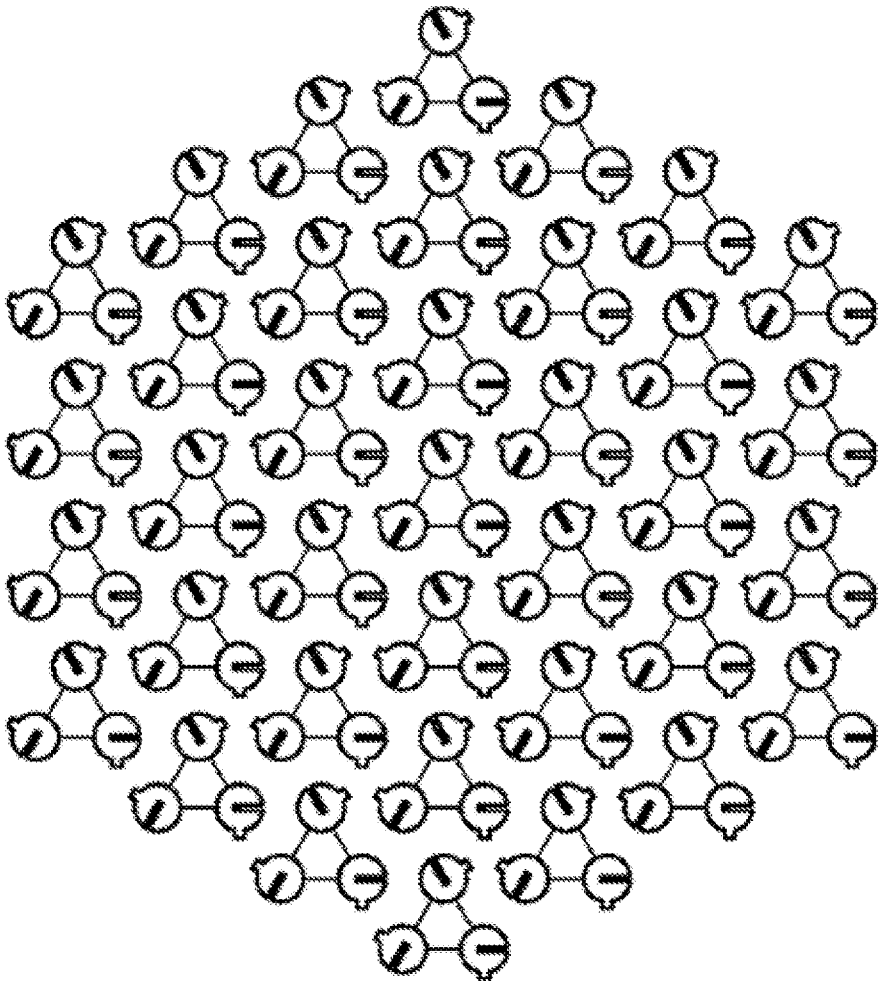

In an example embodiment, and with momentary reference to FIG. 8, a rectangular array of radiating elements can be configured to have rotated radiating elements. The rotation, or "sequential rotation", of the radiating elements can be configured to add dithering at near broadside scanning angles, thus reducing polarization angle and scanning angle errors. Other implementations can be configured to not employ dithering. By way of further explanation, the rotation of one radiating element with respect to another radiating element can generate dithering. Each radiating element can, for example, theoretically generate a limited number of polarization states exactly. Therefore, some error can be introduced by projecting the ideal polarization states on the available polarization states (e.g., by picking the closest polarization state). In an example embodiment, rotating one radiating element relative to another radiating element can cause the exact polarization states to be different between those radiating elements, which can cause the projection error to be different between those radiating elements (causing dithering). Moreover, in an example embodiment, other suitable techniques (besides rotation) can be used to cause the exact polarization states to be different between two or more radiating elements.

Figure 9:
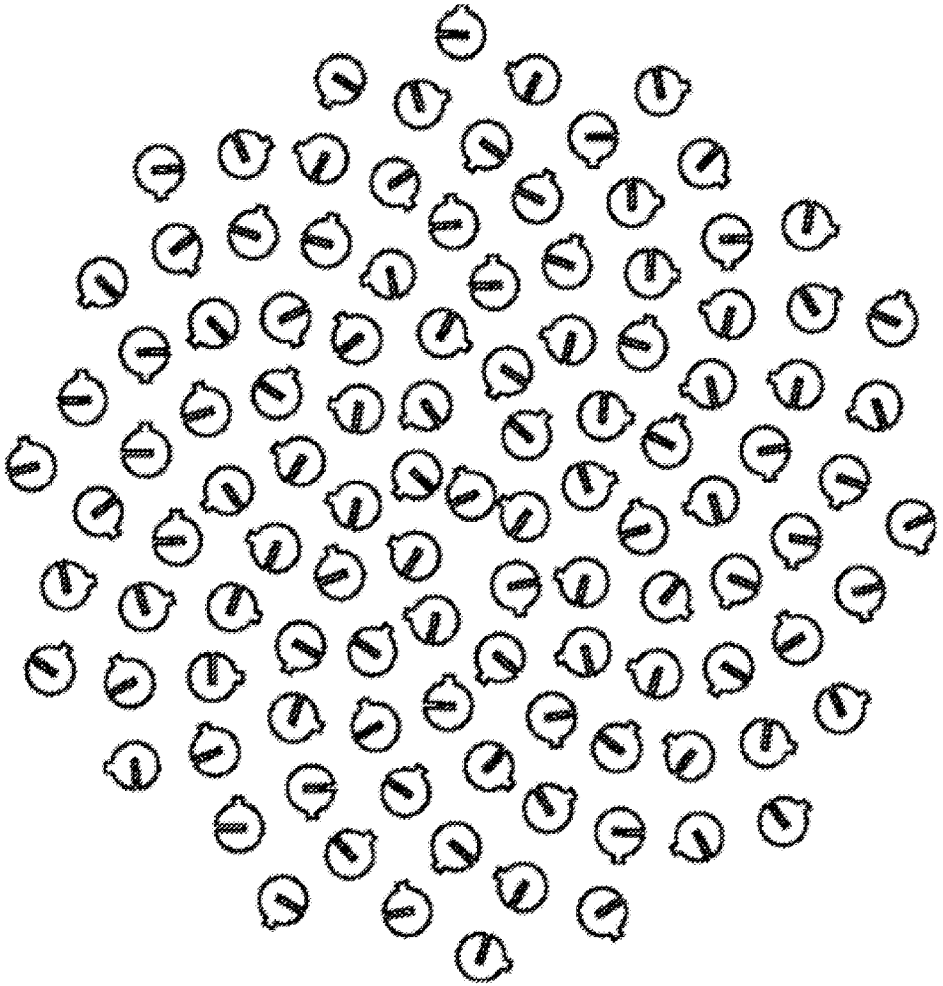

In another example embodiment, and with momentary reference to FIG. 9, an aperiodic array of radiating elements can be configured to have rotated radiating elements.

The radiating elements can, in an example embodiment, comprise dual linear radiating elements. For example, the radiating elements can be microstrip patch antenna elements, such as those fabricated using lithography techniques on a printed circuit board. In an example embodiment, and with reference to FIG. 2, a RE 210 can comprise a first trace 220 connected to a first RE port 211. RE 210 further can comprise a second trace 230 connected to a second RE port 212. In an example embodiment, first trace 220 can be associated with a first slot 225. In an example embodiment, second trace 230 can be associated with a second slot 235. First slot 225 and second slot 235 can be located in a first layer of RE 210. For example, the first layer of RE 210 can comprise a printed circuit board ("PCB"), or other suitable material, with first slot 225 and second slot 235 through the PCB. First trace 220 and second trace 230 can be located in a second layer of RE 210. For example, second layer of RE 210 can comprise a PCB, or other suitable material, that can have first trace 220 and second trace 230. The first layer can be configured to be "above" the second layer, or in other words the first layer can be between the second layer and the source of the RF signals to be received. In an example embodiment, first slot 225 can be perpendicular to first trace 220. In another example embodiment, second slot 235 can be perpendicular to second trace 230. Moreover, in an example embodiment, first slot 225 can be perpendicular to second slot 235.

In an example embodiment, RE 210 can be constructed similar to conventional radiating elements, with the exception of the phase delay to be discussed below. In one example embodiment, the traces can be connected in the bottommost layer, the slots can be in the middle layer, and the patch can be in the topmost layer. Moreover, other suitable construction designs can be used that result in a radiating element with two slots and that is configured for generating signals having orthogonal polarizations.

In accordance with various example embodiments, first trace 220 can have a first trace length, which can be measured as the linear length of trace 220 from the superimposed intersection of first trace 220 with first slot 225 to the first RE port 211. Also, second trace 230 can have a second trace length, which can be measured as the linear length of second trace 230 from the superimposed intersection of second trace 230 with second slot 235 to the second RE port 212. As noted elsewhere herein, the first and second traces can also be measured from the respective slots to the respective point of switching within switch 120.

In an example embodiment, the phase delay difference between the first and second RE ports 211/212 can be due, at least in part, to a difference between the first trace length and the second trace length. In another example embodiment, the phase delay difference between the first and second RE ports 211/212 can also or separately be due to bending/turns in the trace, etc. In another example embodiment, the phase delay difference between the first and second RE ports 211/212 can be due, at least in part, to a phase delay element in one of the first trace 220 or second trace 230. Moreover, the phase delay element in one trace (for example in the first trace 220) can be additional trace length in that trace (here the first trace 220) beyond the trace length of the other trace (here the second trace 230). In an example embodiment, a phase delay element can be provided in both traces, so long as the phase delay in one trace is greater than the phase delay in the other trace. In an example embodiment, it any suitable manner of creating a difference in phase delay between the two traces or "legs" can be used. Thus, the "phase delay" is a relative phase delay between the two traces or legs.

Figure 10:
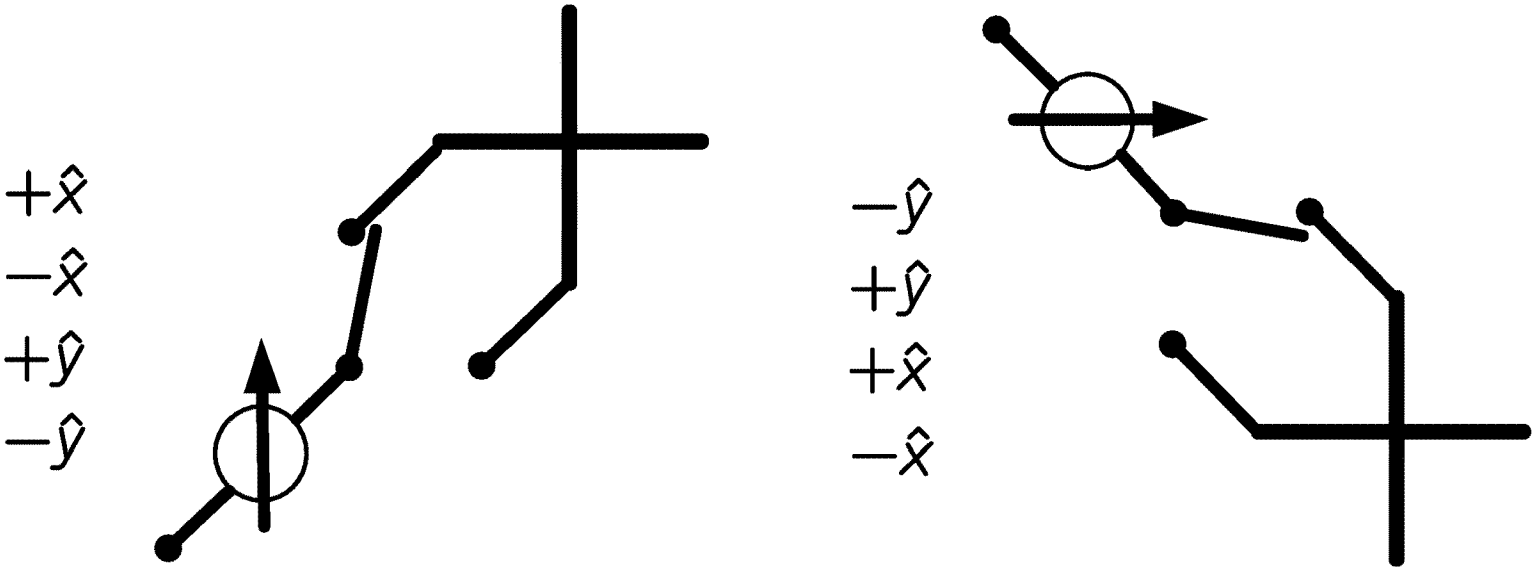
FIGS. 10-11 illustrate two example radiating element schematics.
Figure 11:
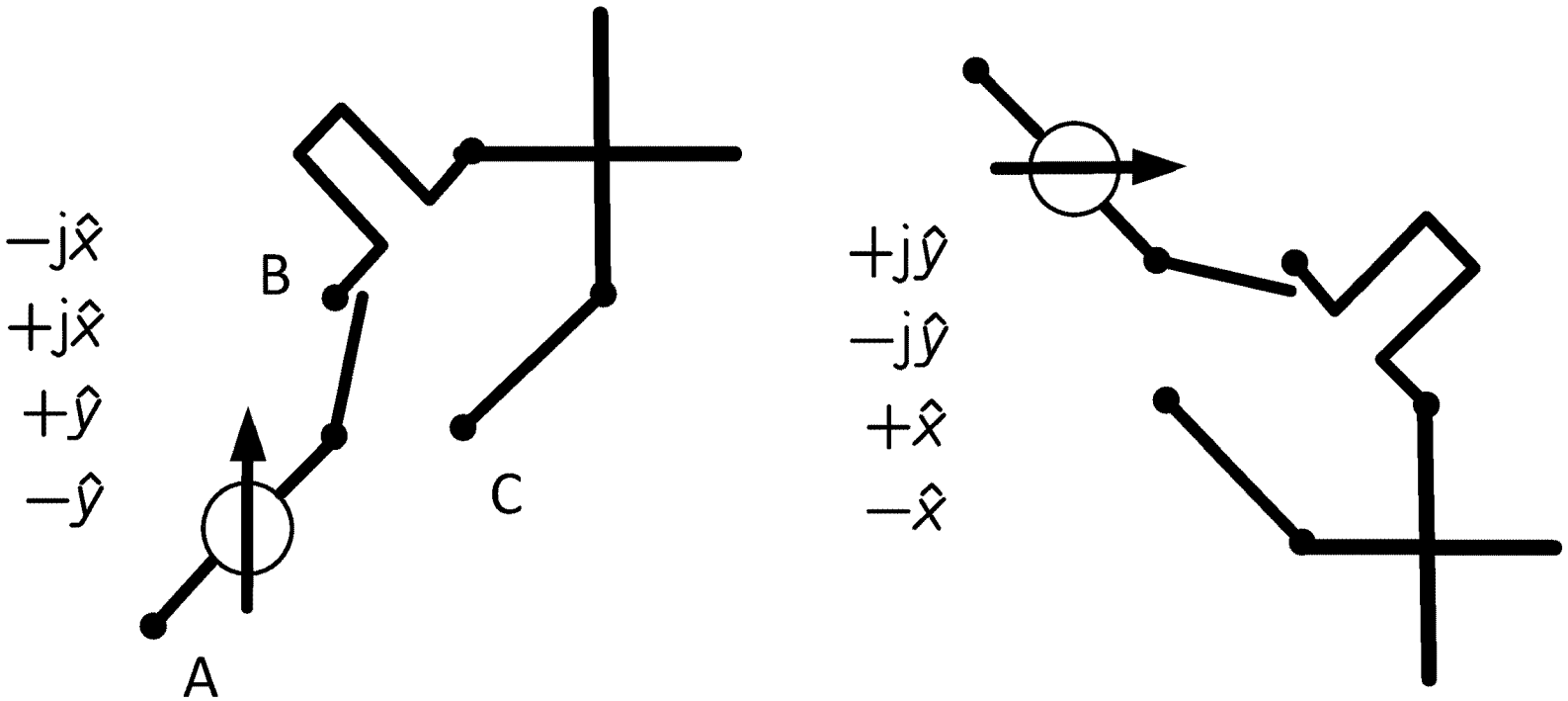

In one example embodiment, the phase delay difference between the first and second RE ports 211/212 can be 90 degrees. Moreover, the phase delay difference can be any suitable phase delay difference. In an example embodiment, the phase delay difference can be configured to facilitate differentiation between forward and backwards directions when scanning with 1-bit phase shifter control. For comparison, FIGS. 10 and 11 illustrate an example dual-linear based 1-bit element having no phase delay (FIG. 10) and a phase delay in one leg (FIG. 11). In the no phase delay embodiment, only two phase states (0° and 180°) can be generated for any orientation of a linearly polarized field. The duplicated beam can be eliminated by modifying the radiating cell so that, when it is rotated, additional phase values can be generated. In an example embodiment and with reference to FIG. 11, this can be done by adding a quarter wavelength transmission line to one of the ports of the radiating element. The addition of the quarter wave length transmission line can provide a 90° phase shift in the delay transmission line relative to the non-delayed transmission line. In this phase delay embodiment, four phase states (0°, 90°, 180°, and 270°) can be generated for any orientation of a linearly polarized field.

Moreover, it should be noted that the phase delay could be provided anywhere along the path or "leg" from the RE slot to within the switch. For example, the phase delay difference can be provided on the connection between one of RE ports 211/212 and switch 120. In another embodiment, the phase delay difference can be introduced internal to switch 120. Thus, the phase delay difference between the two legs associated with RE 110 can be created within RE 110, within switch 120, and/or between these two elements.

In accordance with various aspects, the radiating cell can be a 1-bit radiating cell. Thus, in an example embodiment, the radiating cell can be controlled with a single bit control signal. In an example embodiment, the phase shifter can be a 1-bit phase shifter (single bit phase shifter). Thus, in an example embodiment, the phase shifter can be controlled with a 1-bit signal. In other words, one of two phase shifting states can be selected, where the difference between the two states can be the phase delay between the two ports of the phase shifter. In an example embodiment, radiating cell 101 and radiating cell 102 can be controlled by one or more controllers (not illustrated). The controllers can be any suitable controller configured to perform polarization control. In an example embodiment, each RE can be configured to perform electronic polarization control.

Figure 3:
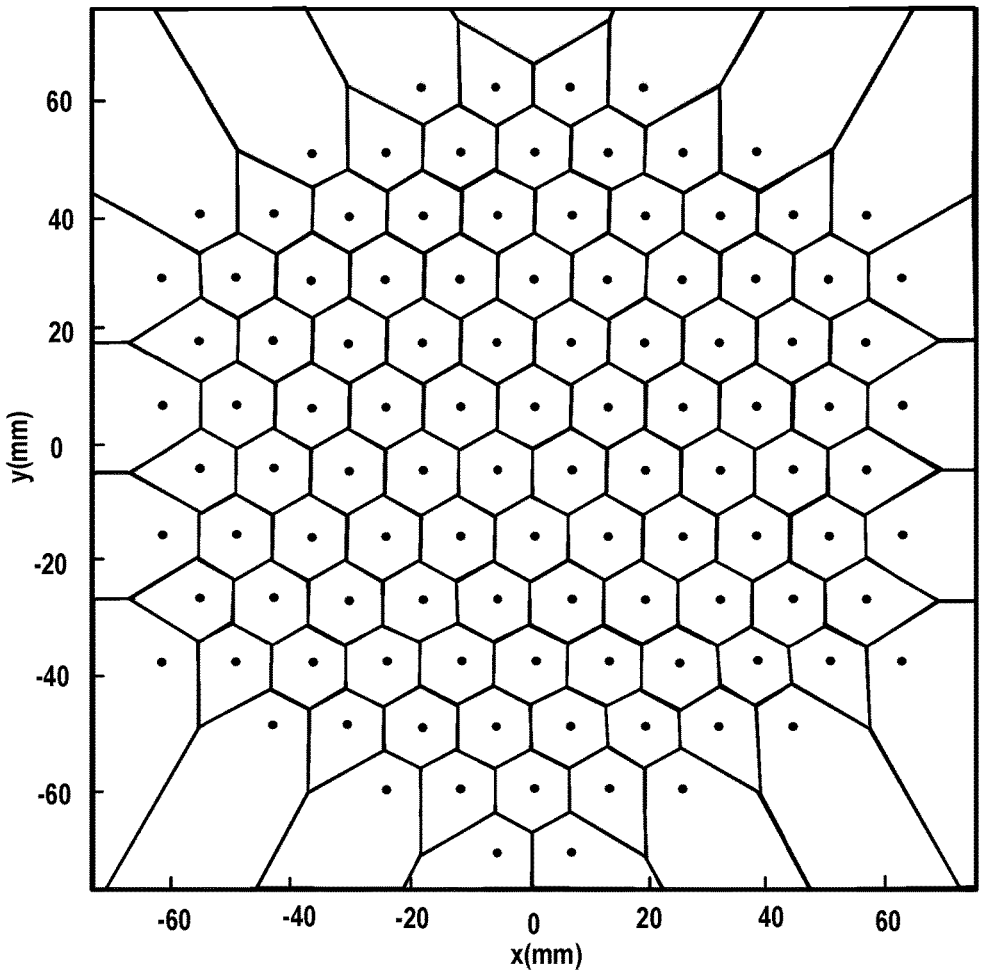
FIGS. 3-9 illustrate various example radiating element arrays.
Figure 4:
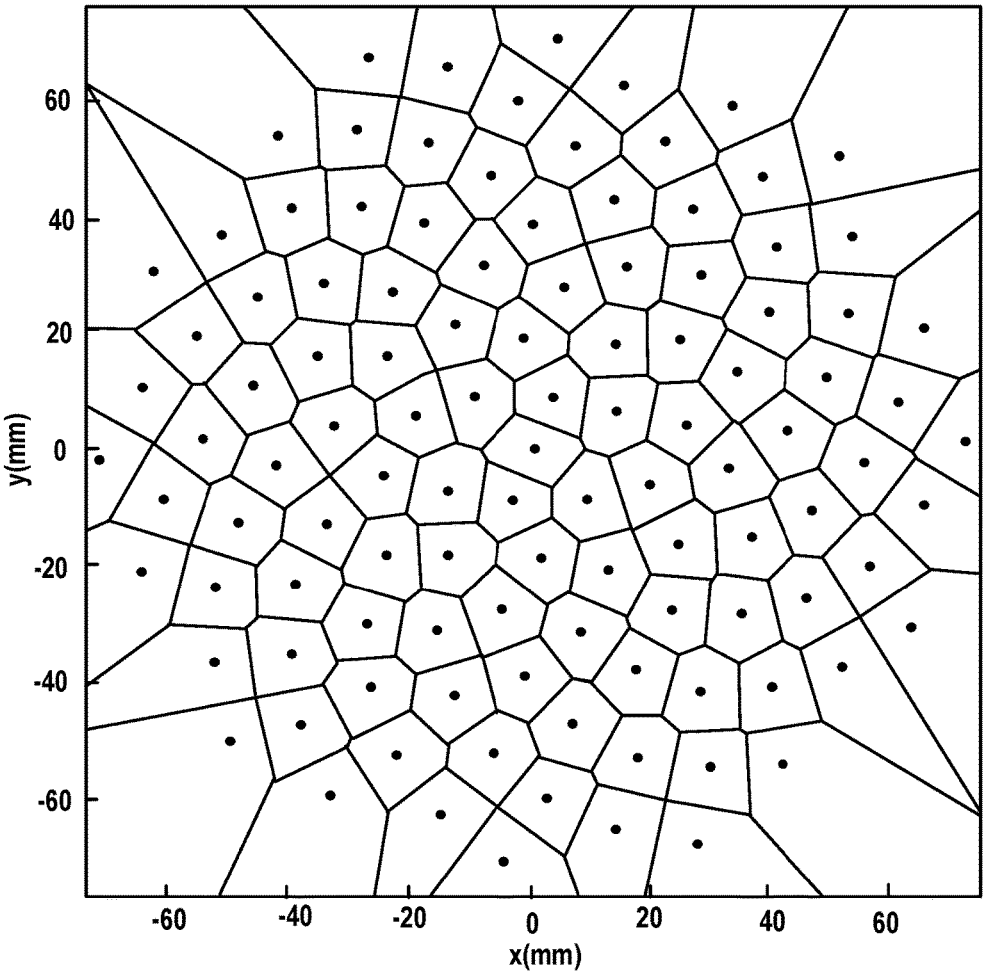
Figure 5:
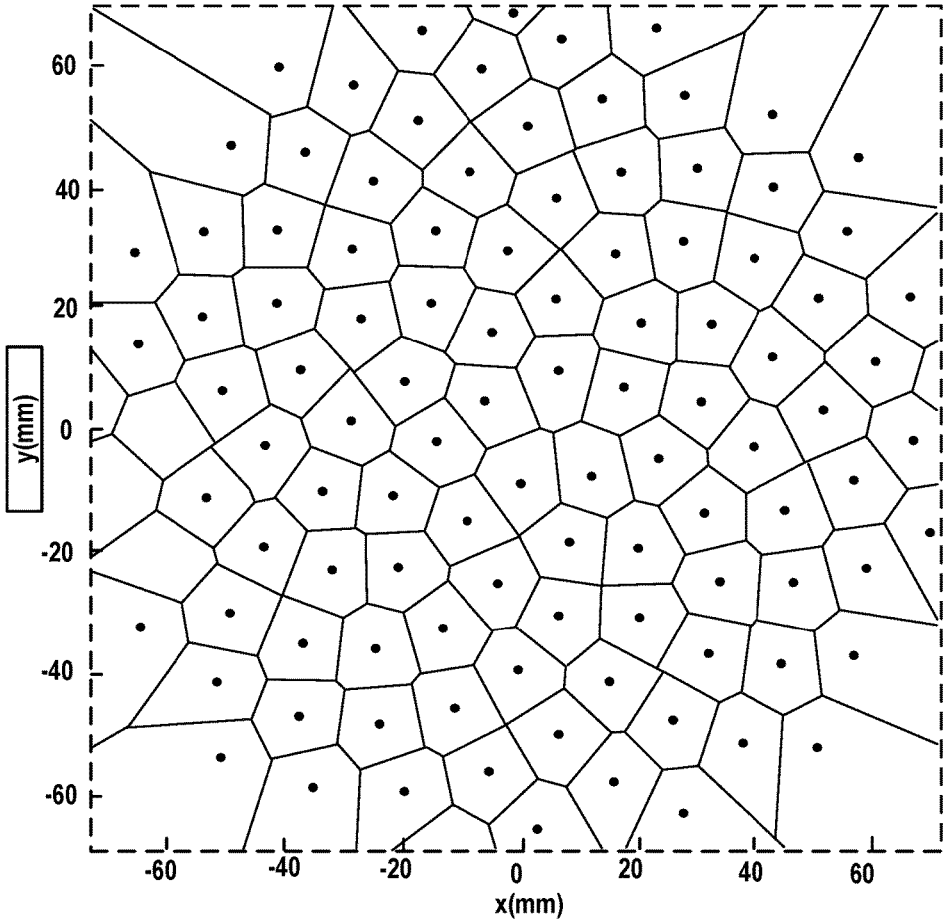
Figure 6:
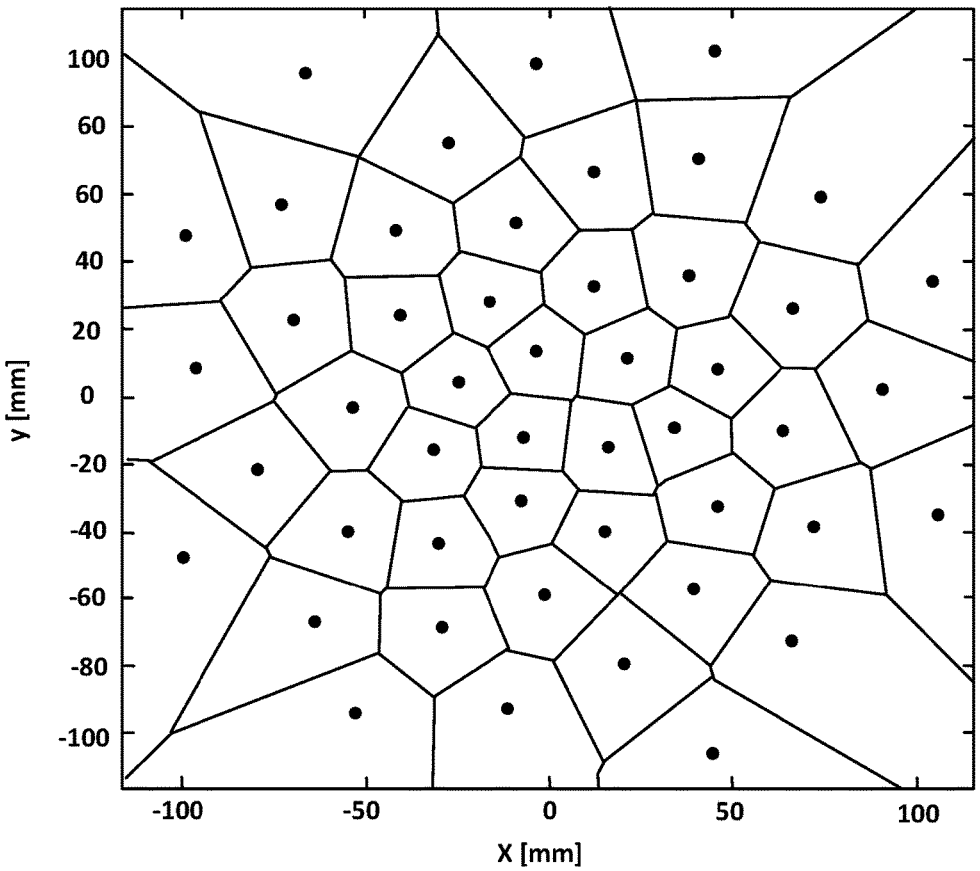

In an example embodiment, the antenna arrays can have various arrangements and layouts of radiating elements. Stated another way, the radiating elements or radiating cells can be laid out in a number of different ways. In one example embodiment, and with momentary reference to FIG. 3, the antenna array can be a uniform array of radiating elements. In another example embodiment, and with momentary reference to FIG. 4, the antenna array can be a non-uniform array of radiating elements. In a further example embodiment, the array of radiating elements can be an aperiodic array. The aperiodic array can be implemented as a spiral array lattice, a flower array lattice, a circular array lattice, or the like. Moreover, any suitable aperiodic array lattice can be used. For example, FIG. 4 illustrates a mirrored Fibonacci-spiral configuration for an aperiodic array lattice. In another example embodiment, FIG. 5 illustrates an aperiodic array lattice implementing an unmirrored Fibonacci-spirals configuration. In yet another example embodiment, FIG. 6 illustrates a tapered aperiodic array lattice implementing an unmirrored Fibonacci-spirals configuration.

Figure 7:
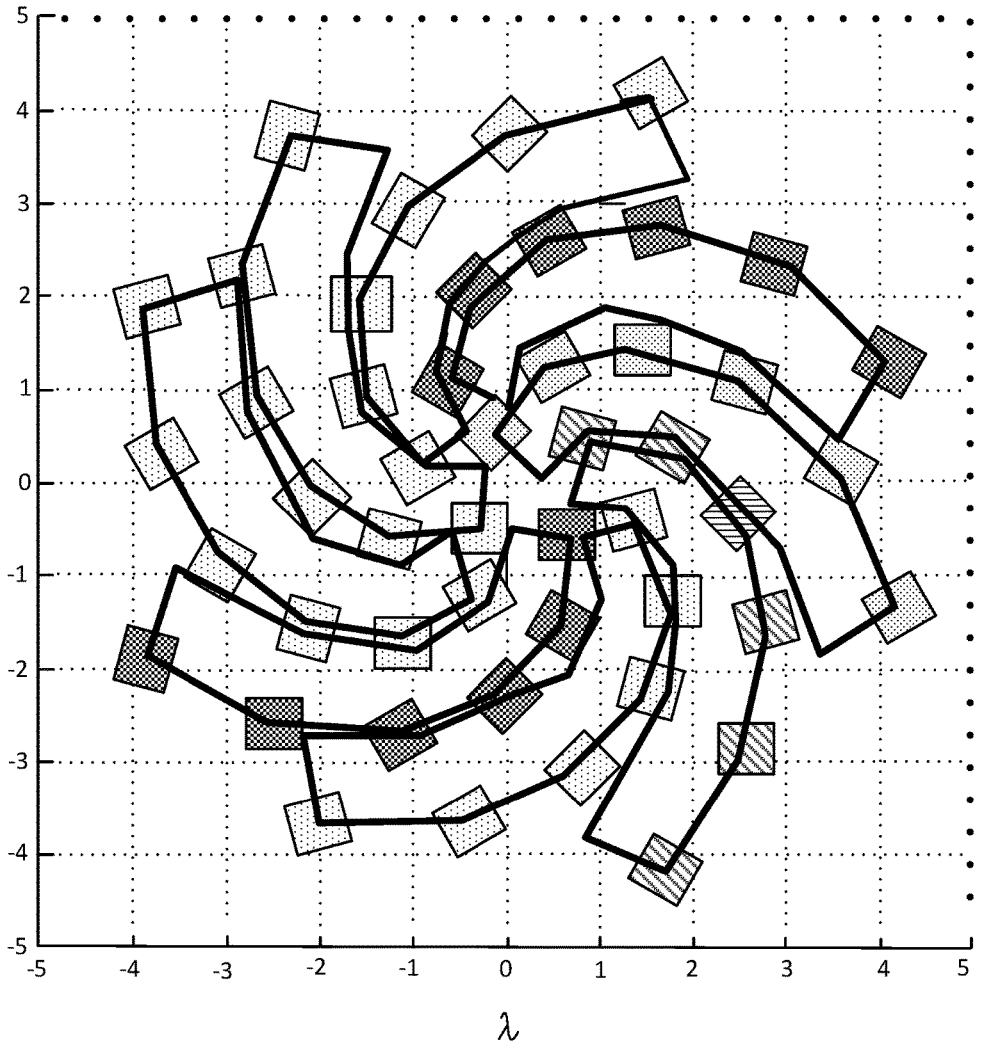

The use of non-rectangular lattices, and in particular, aperiodic lattices, can be configured to reduce grating lobes when the array is scanned to a wide angle. Moreover, the aperiodic distribution of the radiating elements can be configured to suppress both grating lobes and subarraying lobes. In another example embodiment, for azimuthally uniform coverage, the radiating element arrangement can be uniform or approximately uniform such as with appropriately scaled Fibonacci spirals. See FIGS. 4 and 5 as examples. In an example embodiment, and with momentary reference to FIG. 7, the radial positions of the elements in the array can be scaled to generate a particular side lobe profile in the radiation pattern. The structure of the Fibonacci spirals can be used to partition the beam forming network so that the sections for each spiral arm can be reused. The Fibonacci spiral can have the benefits of being relatively very even, as opposed to having a particular cell with relatively large amounts of free space about it while having another group of cells clustered together with relatively little free space about them. In an example embodiment, a uniform array can have relative rotation between radiating elements in the array and still be called a uniform array.

In an example embodiment, each radiating cell (e.g., 101, 102) can comprise a switch 120. Switch 120 can be connected to second PS port 132. Switch 120 can be configured to be selectively connected to the first RE port 111 or the second RE port 112. In an example embodiment, each radiating cell only comprises a single switch. In an example embodiment, the single switch 120 can be a single pole, double throw switch. Moreover, single switch 120 can comprise any suitable switch for selectively connecting second PS port 132 to first RE port 111 or second RE port 112.

Thus, in an example embodiment, an antenna array can comprise at least two radiating cells, wherein each radiating cell can comprise a radiating element having two RE ports that can be selectively connected to a phase shifter. The radiating cell can further comprise a phase delay difference between the first and second radiating element ports. Moreover, the first radiating cell 101 can be rotated relative to the second radiating cell 102.

In an example embodiment, the switches and the phase shifters can be controlled by one or more controllers. In an example embodiment, the switches and the phase shifters can be controlled jointly to modify the antenna array radiation pattern as desired. For example, the controller can control the radiation pattern to scan the beam at a particular direction or to turn the polarization to a desired angle.

Thus, in an example embodiment, the rotation of radiating elements compared to other radiating elements can be configured to compensate for the reduction in the number of control bits used in the antenna array that result in limited phase states. However, when the number of control bits is reduced to 1 bit, the non-periodic array can generate a duplicated main beam that can halve the maximum directivity of the array. This duplicated main beam can be eliminated by a suitable rotation of the elements combined with a specific, fixed phase difference between the two ports of each element. The resulting 1-bit phased array can be configured to have a performance that scales with size along one or more of its dimensions: directivity, sidelobe levels, pointing errors, and polarization errors.

In the various embodiments described herein, the antenna array can be one of: a transmit antenna array, a receive antenna array, and a transceiver antenna array. In accordance with an example embodiment, the antenna array can be formed of monolithic microwave integrated circuits. In other embodiments, the switch and/or phase shifter can be formed of discrete components. Moreover, the antenna array can be configured to perform beam steering.

In accordance with various aspects, an example method of controlling an antenna array can comprise receiving a first one-bit control signal to control a first phase shifter in a first radiating cell. In this example method, the first radiating cell can comprise a first switch, the first phase shifter, and a first radiating element. The first radiating element can comprise a first radiating element port and a second radiating element port. The method can further comprise using the first switch to selectively connect the first phase shifter to one of the first radiating element port and the second radiating element port of the first radiating element. The method can further comprise receiving a second one-bit control signal to control a second phase shifter in a second radiating cell. The second radiating cell can comprise a second switch, the second phase shifter, and a second radiating element. The second radiating element can comprise a third radiating element port and a fourth radiating element port. The method can further comprise using the second switch to selectively connect the second phase shifter to one of the third radiating element port and the fourth radiating element port of the second radiating element. The first radiating cell can be rotated relative to the second radiating cell. The method can further comprise providing a first phase delay difference between the signal paths associated with the first and second radiating element ports; and providing a second phase delay difference between the signal paths associated with the third and fourth radiating element ports.

In this disclosure, the following terminology is used: The singular forms "a," "an," and "the" include plural referents unless the context clearly dictates otherwise. Thus, for example, reference to an item includes reference to one or more items. The term "ones" refers to one, two, or more, and generally applies to the selection of some or all of a quantity. The term "plurality" refers to two or more of an item. The term "about" means quantities, dimensions, sizes, formulations, parameters, shapes and other characteristics need not be exact, but may be approximated and/or larger or smaller, as desired, reflecting acceptable tolerances, conversion factors, rounding off, measurement error and the like and other factors known to those of skill in the art. The term "substantially" means that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide. Numerical data may be expressed or presented herein in a range format. It is to be understood that such a range format is used merely for convenience and brevity and thus should be interpreted flexibly to include not only the numerical values explicitly recited as the limits of the range, but also interpreted to include all of the individual numerical values or sub-ranges encompassed within that range as if each numerical value and sub-range is explicitly recited. As an illustration, a numerical range of "about 1 to 5" should be interpreted to include not only the explicitly recited values of about 1 to about 5, but also include individual values and sub-ranges within the indicated range. Thus, included in this numerical range are individual values such as 2, 3 and 4 and sub-ranges such as 1-3, 2-4 and 3-5, etc. This same principle applies to ranges reciting only one numerical value (e.g., "greater than about 1") and should apply regardless of the breadth of the range or the characteristics being described. A plurality of items may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. Furthermore, where the terms "and" and "or" are used in conjunction with a list of items, they are to be interpreted broadly, in that any one or more of the listed items may be used alone or in combination with other listed items. The term "alternatively" refers to selection of one of two or more alternatives, and is not intended to limit the selection to only those listed alternatives or to only one of the listed alternatives at a time, unless the context clearly indicates otherwise.

It should be appreciated that the particular implementations shown and described herein are illustrative of the invention and are not intended to otherwise limit the scope of the present invention in any way. Furthermore, the connecting lines shown in the various figures contained herein are intended to represent exemplary functional relationships and/or physical couplings between the various elements. It should be noted that many alternative or additional functional relationships or physical connections may be present in a practical device.

As one skilled in the art will appreciate, the mechanism of the present invention may be suitably configured in any of several ways. It should be understood that the mechanism described herein with reference to the figures is but one exemplary embodiment of the invention and is not intended to limit the scope of the invention as described above.

It should be understood, however, that the detailed description and specific examples, while indicating exemplary embodiments of the present invention, are given for purposes of illustration only and not of limitation. Many changes and modifications within the scope of the instant invention may be made without departing from the spirit thereof, and the invention includes all such modifications. The corresponding structures, materials, acts, and equivalents of all elements in the claims below are intended to include any structure, material, or acts for performing the functions in combination with other claimed elements as specifically claimed. The scope of the invention should be determined by the appended claims and their legal equivalents, rather than by the examples given above. For example, the operations recited in any method claims may be executed in any order and are not limited to the order presented in the claims. Moreover, no element is essential to the practice of the invention unless specifically described herein as "critical" or "essential."

What is claimed is:

1. An antenna array comprising:

a plurality of radiating cells including a first radiating cell and a second radiating cell, wherein the first radiating cell is rotated relative to the second radiating cell, and each of the first radiating cell and the second radiating cell comprise:

a dual linear polarized radiating element comprising a first radiating element port and a second radiating element port;

a phase shifter to apply a phase shift to a signal communicated between the dual linear polarized radiating element and a radiating cell input/output port;

a phase delay element and a switch coupled between the dual linear polarized radiating element and the phase shifter, wherein the phase delay element applies a phase delay difference between signal paths associated with the first and second radiating element ports, and the switch controls coupling of the radiating cell input/output port to the first and second radiating element ports to control polarization associated with the signal.

2. The antenna array of claim 1, wherein the phase delay difference of the phase delay element of each of the first radiating cell and the second radiating cell is fixed, and the phase shift applied by the phase shifter of each of the first radiating cell and the second radiating cell is configurable from among a plurality of phase shifting states.

3. The antenna array of claim 1, further comprising at least one controller to provide commands to the phase shifter and the switch of each of the first and second radiating cells.

4. The antenna array of claim 1, wherein the dual linear polarized radiating element of the first radiating cell has a first physical polarization orientation, and the the dual linear polarized radiating element of the second radiating cell has a second physical polarization orientation different than the first physical polarization orientation.

5. The antenna array of claim 1, the dual linear polarized radiating element of each of the first radiating cell and the second radiating cell is a microstrip patch antenna element.

6. The antenna array of claim 5, wherein the microstrip patch antenna element of each of the first radiating cell and the second radiating cell includes a first slot coupled to the first radiating element port and a second slot coupled to the second radiating element port.

7. The antenna array of claim 5, wherein the microstrip patch antenna element of each of the first radiating cell and the second radiating cell includes a multi-layer circuit board.

8. The antenna array of claim 1, wherein the first radiating element port of the first radiating cell corresponds to a first polarization, and the second radiating element port of the second radiating cell corresponds to a second polarization.

9. The antenna array of claim 1, wherein the plurality of radiating cells further includes a third radiating cell rotated relative to the first and second radiating cells.

10. The antenna array of claim 1, wherein the first radiating cell selectively generates one of a plurality of first phase states of the signal, and the second radiating cell selectively generates one of a plurality of second phase states of the signal.

* * * * *